US006845548B1

(12) United States Patent
Lin

(10) Patent No.: US 6,845,548 B1
(45) Date of Patent: Jan. 25, 2005

(54) BUCKLE ASSEMBLY FOR MOUNTING GOGGLE ON HELMET

(75) Inventor: Hung-Chin Lin, Changhua (TW)

(73) Assignee: Lifestyle Metal Co., Ltd., Changhua (TW)

( * ) Notice: Subject to any disclaimer, the term of this patent is extended or adjusted under 35 U.S.C. 154(b) by 0 days.

(21) Appl. No.: 10/660,714

(22) Filed: Sep. 12, 2003

(51) Int. Cl.[7] ..... A44B 17/00; A44B 11/25; A45F 5/02

(52) U.S. Cl. ..... 24/265 BC; 24/3.3; 24/3.8; 24/196; 24/324; 24/625; 2/10; 2/424

(58) Field of Search ..... 24/265 BC, 3.3, 24/3.8, 428, 452, 324, 115 H, 196, 625; 2/10, 440, 424; 351/112, 157; 119/14.1, 865

(56) References Cited

U.S. PATENT DOCUMENTS 3,210,820 A * 10/1965 Humiston ..... 24/625
3,808,604 A * 5/1974 Rose ..... 2/10
4,035,877 A * 7/1977 Brownson et al. ..... 24/196
5,165,117 A * 11/1992 Kamata ..... 2/424
5,230,101 A * 7/1993 Hedges et al. ..... 2/424
5,333,329 A * 8/1994 Hong ..... 2/424
5,845,369 A * 12/1998 Dunchock ..... 24/3.3
5,987,652 A * 11/1999 Fowler ..... 2/424
6,032,339 A * 3/2000 D'Addario ..... 24/265 BC

* cited by examiner

*Primary Examiner*—Victor Sakran
(74) *Attorney, Agent, or Firm*—Bacon & Thomas PLLC

(57) ABSTRACT

A buckle assembly for mounting a goggle on a helmet. The goggle is connected with a strap. The buckle assembly includes a first buckle having a main body. The strap is connected at an end of the main body. A buckling portion is formed on the main body. The buckling portion forms a buckling hole and a buckling flange, and a grip portion is connected to another end of the main body. A second buckle includes a main plate and a locating portion, a buckling portion which is formed of catch plates which can be bent inwards and outwards, and a claw is outwardly disposed on each catch plate for catching the buckling flange of the first buckle. A buckle locator includes a base, a locating portion for connecting the locating portion of the second buckle, and allocating portion for connecting the helmet.

9 Claims, 4 Drawing Sheets

BUCKLE ASSEMBLY FOR MOUNTING GOGGLE ON HELMET

BACKGROUND OF THE INVENTION

1. Field of the Invention

The present invention relates generally to a goggle mounting system, and more specifically, to a buckle assembly for mounting goggle on helmet.

2. Description of the Related Art

There are many types of goggles on the market for use either independently of or in combination with a helmet for various needs, including those where the user wears both a protective helmet and finds goggles helpful in protecting his eyes. Such users are dirt bike motorcyclists, dunebuggy drivers and passengers, and the like.

Some of these goggles have straps which completely encircle the wearer's head. He can put on the goggles before the helmet, and, in this case, the goggles cannot be adjusted until the helmet is removed. If he places the goggle strap over the helmet, the wearer often has trouble putting the goggles in place, especially if the helmet has a visor and/or chin protector.

Other goggles are arranged to snap directly on the helmet, but these are limited as to adjustability; and the manner in which they are attached to the helmet inhibits their adjustability, their attachment, and their detachment during driving. Thus, there is need for a goggle apparatus which allows for quick connecting and disconnecting and ease of adjustment.

SUMMARY OF THE INVENTION

The present invention has been accomplished to provide a buckle assembly for mounting goggle on helmet, which the goggles can be easily and securely put in place, adjusted and removed.

It is therefore the main object of the present invention to provide a buckle assembly for mounting goggle on helmet, wherein the user wearing a helmet can adjust his goggles with one hand, including retrieving them from the open position, engaging them across his eyes, adjusting them, and securing them in place, as well as readjusting and removing the goggles.

It is another object of the present invention to provide a buckle assembly for mounting goggle on helmet, which the lock structure of the present invention can be buckle and unbuckle by hand quickly, and the buckled power is strong and will not escape at ease.

To achieve these and other objects of the present invention, the buckle assembly for mounting goggle on helmet, wherein the goggle connected with a strap, the buckle assembly including a first buckle having a main body, the strap being connected at an end of the main body, a buckling portion formed on the main body, the buckling portion forming a buckling hole and a buckling flange, and a grip portion connected to another end of the main body; a second buckle having a main plate and forming a locating portion, a buckling portion which formed of a plurality of catch plates which can be bend inwards and outwards, and a claw outwardly disposed on each catch plate for catching the buckling flange of the first buckle; a buckle locator having a base, a locating portion for connecting the locating portion of the second buckle, and a locating portion for connecting the helmet.

DETAILED DESCRIPTION OF THE PREFERRED EMBODIMENT

Figure 1:
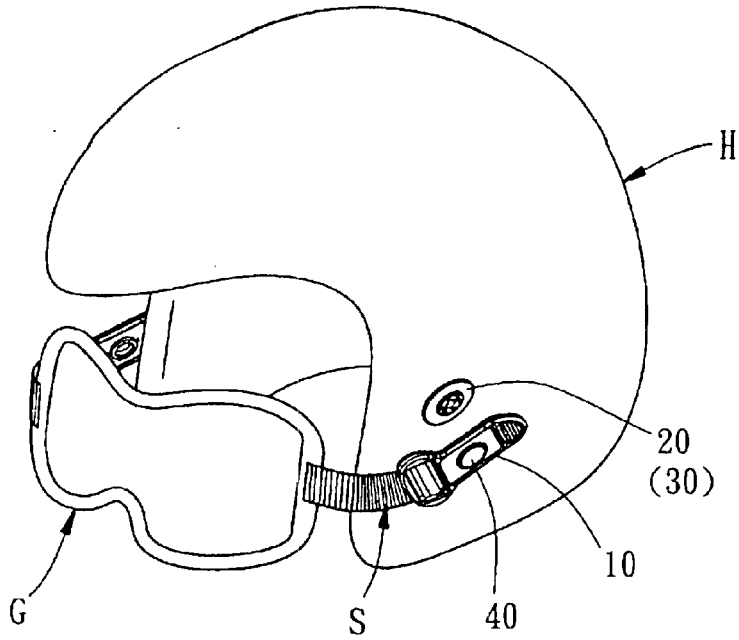
FIG. 1 is a schematic view of a preferred embodiment of the present invention connected to a goggle and a helmet.
Figure 2:
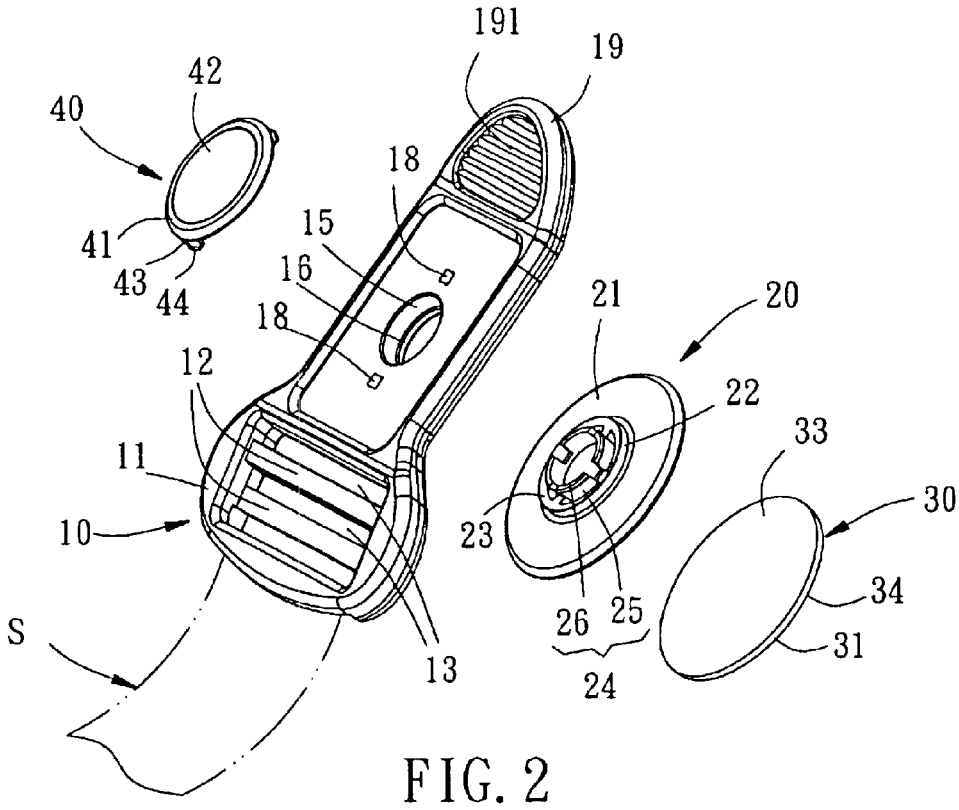
FIG. 2 is an exploded view of the buckle assembly of the preferred embodiment according to the present invention.
Figure 3:
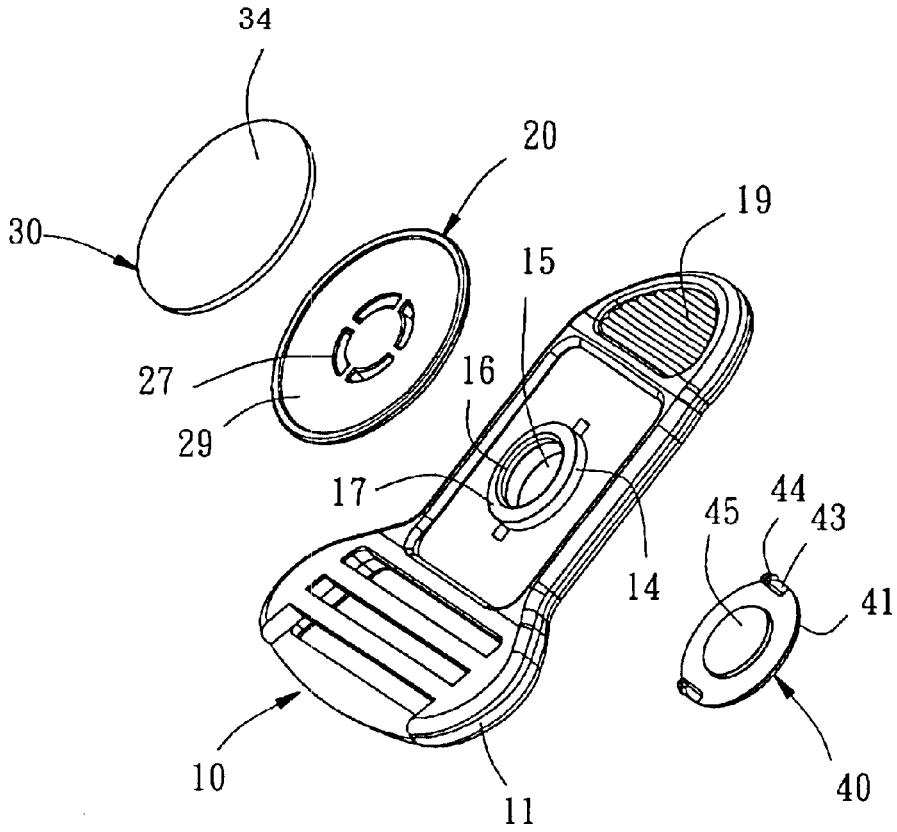
FIG. 3 is another exploded view of the buckle assembly of the preferred embodiment according to the present invention.
Figure 4:
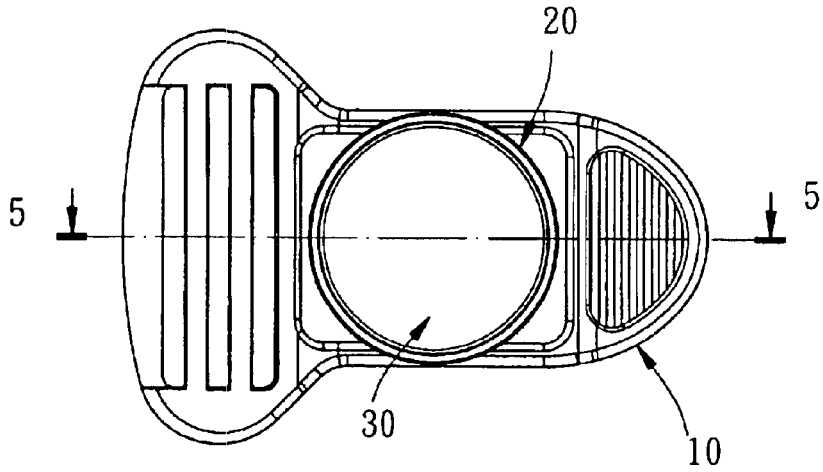
FIG. 4 is a plain assembly view of the buckle assembly of the preferred embodiment according to the present invention.
Figure 5:
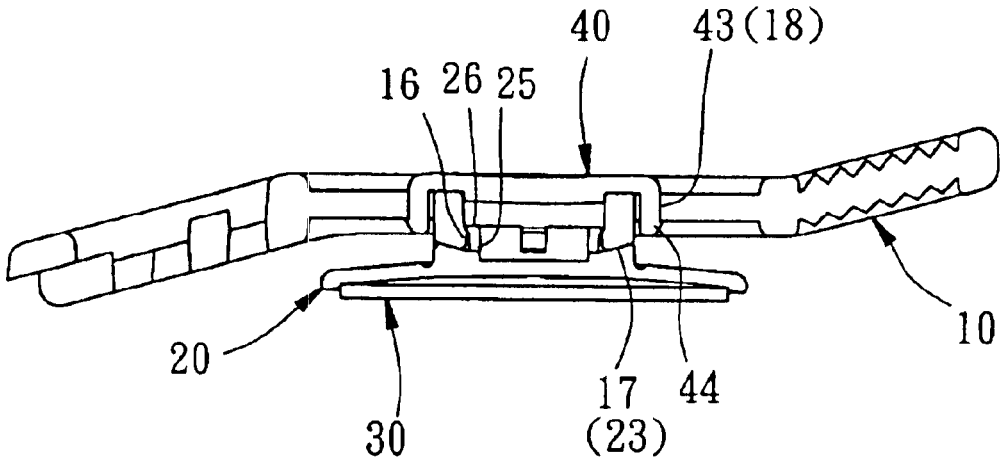
FIG. 5 is a sectional view taken along a line 5—5 indicated in FIG. 4.

Referring to FIGS. from 1 through 6, a preferred embodiment of the buckle assembly for mounting goggle on helmet in accordance with the present invention is shown, which is used to mounting a goggle G on a helmet H, the goggle G is connected with a strap S.

The buckle assembly for mounting goggle on helmet of the embodiment is composed of:

A first buckle 10 includes a main body 11, several posts 12 and stripe holes 13 formed on an end of the main body 11 for connecting the strap S; a buckling portion 14 connected to the main body 11, the buckling portion 14 forming a buckling hole 15, a buckling flange 16, a stop surface 17; two cover lock holes 18, and a grip portion 19 which connects at another end of the main body 11, the grip portion 19 having a plurality of grooves 191 thereon.

A second buckle 20 includes a main plate 21 of annular button shape, a locking emboss 22 and forming a stop surface 23, a buckling portion 24 formed of four catch plates 25 which can be bend inwards and outwards, and having a claw 26 outwardly disposed on each catch plate 25 for catching the buckling flange 16 of the first buckle 10, four escape holes 27 through the main plate 21 and responding to each catch plate 25, and a locating portion 29 that is an adhesive layer formed on the main plate 21 opposite the locking emboss 22 side.

A buckle locator 30 includes a base 31 which formed of composite sponge, a locating portion 33 that is an adhesive layer formed on a face of the base 31 for adhesive to the locating portion 29 of the second buckle 20, and a locating portion 34 that is also an adhesive layer formed on another face of the base 31 for adhesive to the outer surface of the helmet H.

A pressing cover 40 includes a cover portion 41 for cover the buckling hole 15 of the first buckle 10, a press surface 42 form on a side of the cover portion 41, the cover portion 41 is provided for finger to compress the first buckle 10 to coupling the second buckle 20 and prevent hurt of the finger, two lock plates 43 which can be bending and insert into the cover lock hole 18 of the first buckle 10, and a claw 44 formed on each lock plate 43 to fix the pressing cover 40 on the first buckle 10, and an emboss 45.

The operation of the present invention is outlined hereinafter:

In assembling the buckle assembly:

Take each side of adhesive layer 33 of the buckle locator 30 to adhesive the locating portion 29 of the second buckle 20 and the outside surface of the helmet H respectively; and Assembled the pressing cover 40 to the first buckle 10 by the two lock plates 43 of the pressing cover 40 to lock the cover lock hole 18 of the first buckle 10, and let the stripe S connect to the posts 12 and stripe holes 13 of the first buckle 10 for fastening the first buckle 10 to the goggle G. In engaging, the steps are as follows:

Take the assembly of the first buckle 10 and pressing cover 40 by a hand, and make the first buckle 10 coupling to the second buckle 20, then let the buckling hole 15 of the first buckle 10 put to the buckling portion 24 of the second buckle 20, and press in the press surface 42 of the pressing cover 40 by finger to complete lock.

A protocol of buckle assembly for mounting goggle on helmet has been constructed with the features of FIGS. 1–6. The buckle assembly for mounting goggle on helmet functions smoothly to provide all of the features discussed earlier.

Although a particular embodiment of the invention has been described in detail for purposes of illustration, various modifications and enhancements may be made without departing from the spirit and scope of the invention.

Beside the embodiment of above, the quality of the catch plate 25 of the second buckle 20 also can be two or three and others, which achieve the same function.

Figure 7:
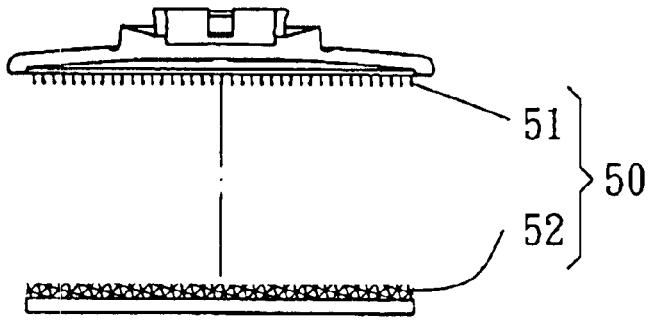
FIG. 7 is an assembly section view of another embodiment according to the present invention.
Figure 6:
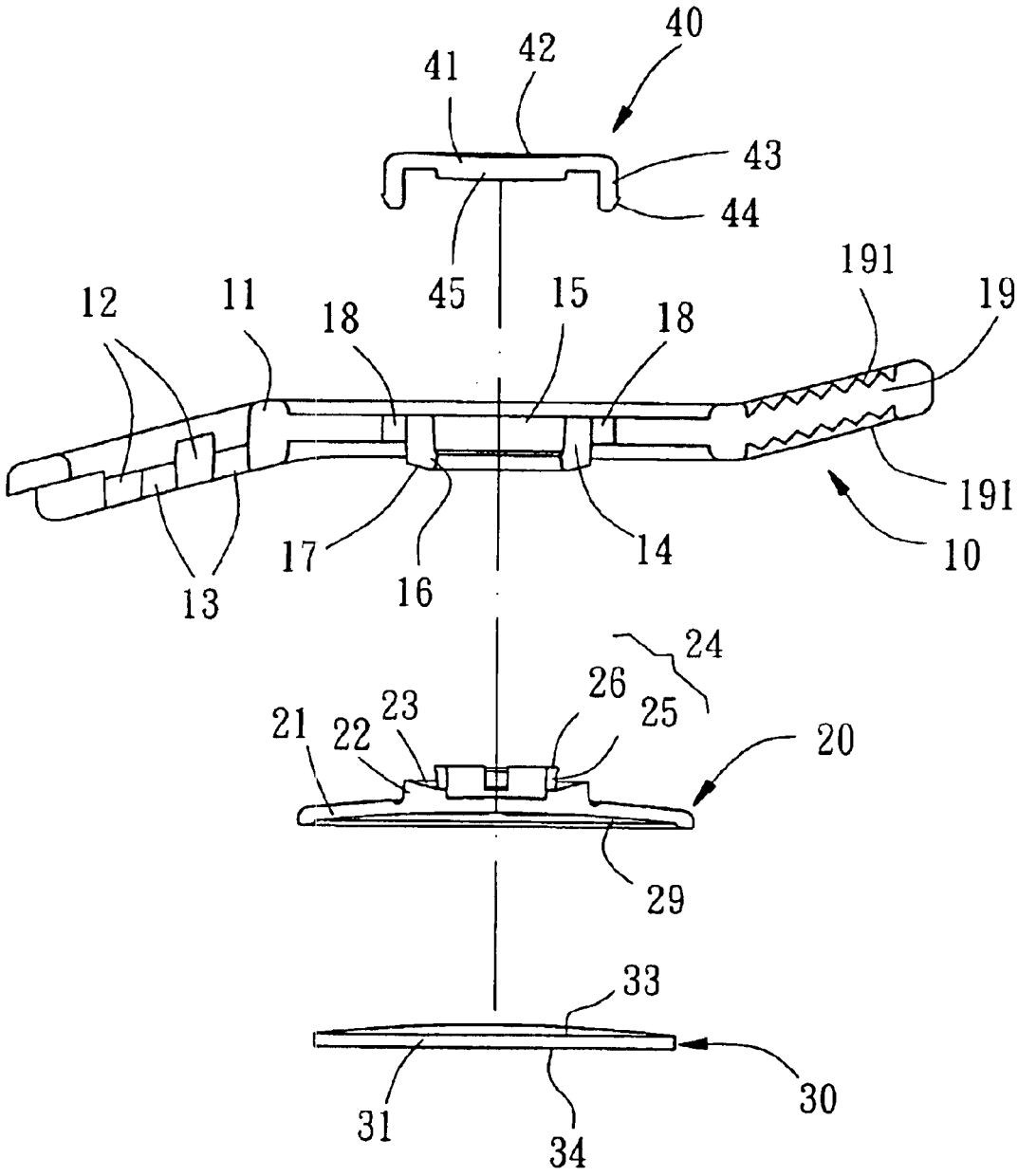
FIG. 6 is a sectional exploded view according the FIG. 5.

Further, please refer FIG. 7, the buckle assembly for mounting goggle on helmet of the present invention further comprising an connection set 50 which is consist of a male magic tape 51 and a female magic tape 52 connected to the second buckle and the buckle locator respectively.

And, it is interchangeable on the buckling portion of the first buckle and the buckling portion of the second buckle, that is the first buckle comprise the catch plate, and the second buckle comprise the buckling hole for insert of the catch plate of the first buckle.

As indicated above, the buckle assembly for mounting goggle on helmet has the following advantages:

The buckle assembly for mounting goggle on helmet of the present invention, wherein the first buckle and second buckle is simply and strong enough in structure, which can be product and assemble easily, and 2. The buckle assembly for mounting goggle on helmet of the present invention, the lock structure of the present invention can be buckle and unbuckle by hand quickly, and the buckled power is strong and will not escape at ease.

What the invention claimed is:

1. A buckle assembly for mounting goggle on helmet, wherein said goggle is connected with a strap, said buckle assembly comprising:

a first buckle having a main body, said strap being connected at an end of said main body, a buckling portion formed on said main body, said buckling portion forming a buckling hole and a buckling flange, and a grip portion connected to another end of said main body;

a second buckle having a main plate and forming a locating portion, a buckling portion which is formed of a plurality of catch plates which can be bent inwards and outwards, and a claw outwardly disposed on each catch plate for catching said buckling flange of said first buckle;

a buckle locator having a base, a locating portion for connecting said locating portion of said second buckle, and a locating portion for connecting said helmet; and wherein said buckling hole of said first buckle extends through said main body, and said buckle assembly further comprises a dressing cover having a cover portion to cover said buckling hole of said first buckle.

2. The buckle assembly for mounting goggle on helmet as claimed in claim 1, wherein said locating portions of said buckle locator are an adhesive layer.

3. The buckle assembly for mounting goggle on helmet as claimed in claim 1, wherein said first buckle further comprise two cover lock holes, and said pressing cover further comprise two lock plates which can be bent and inserted into said cover lock hole of said first buckle.

4. The buckle assembly for mounting goggle on helmet as claimed in claim 3, wherein said each lock plate of said pressing cover further forms a claw to prevent escape.

5. The buckle assembly for mounting goggle on helmet as claimed in claim 1, further comprising a connection set which connect said second buckle and said buckle locator.

6. The buckle assembly for mounting goggle on helmet as claimed in claim 5, wherein said connection set is a male magic tape and a female magic tape.

7. The buckle assembly for mounting goggle on helmet as claimed in claim 1, wherein said buckling portion of said second buckle is in quality of four.

8. The buckle assembly for mounting goggle on helmet as claimed in claim 1, wherein said first buckle further having a stop surface, said second buckle having a stop surface being stopped by said stop surface of said first buckle.

9. The buckle assembly for mounting goggle on helmet as claimed in claim 1, wherein said grip portion of said first buckle having a plurality of grooves thereon.

* * * * *